US007137845B2

(12) United States Patent
Bernat et al.

(10) Patent No.: US 7,137,845 B2
(45) Date of Patent: Nov. 21, 2006

(54) PLUG CONNECTOR

(75) Inventors: Jean Francois Bernat, Sartrouville (FR); Jean-Merri De Vanssay, Paris (FR)

(73) Assignee: Harting Electronics GmbH & Co. KG (DE)

( * ) Notice: Subject to any disclaimer, the term of this patent is extended or adjusted under 35 U.S.C. 154(b) by 0 days.

(21) Appl. No.: 11/189,328

(22) Filed: Jul. 26, 2005

(65) Prior Publication Data

US 2005/0260882 A1 Nov. 24, 2005

Related U.S. Application Data

(63) Continuation of application No. 10/202,127, filed on Jul. 24, 2002, now abandoned.

(30) Foreign Application Priority Data

Jul. 30, 2001 (DE) ..... 201 12 547 U
Sep. 21, 2001 (DE) ..... 101 46 595

(51) Int. Cl.
*H01R 11/20* (2006.01)
*H01R 4/26* (2006.01)
*H01R 4/24* (2006.01)

(52) U.S. Cl. ..... 439/409; 439/701

(58) Field of Classification Search ..... 439/409, 439/410, 701
See application file for complete search history.

(56) References Cited

U.S. PATENT DOCUMENTS 4,170,315 A * 10/1979 Dubach et al. ..... 220/281
4,455,058 A 6/1984 Harner et al. ..... 439/409
4,713,023 A 12/1987 Bixler et al. ..... 439/393
4,790,763 A 12/1988 Weber et al. ..... 439/65
4,869,676 A 9/1989 Demler et al. ..... 439/79
4,874,329 A 10/1989 Yu ..... 439/409
5,358,430 A 10/1994 Bonvallat et al. ..... 439/676
5,435,747 A 7/1995 Franckx et al. ..... 439/409
5,667,402 A 9/1997 Denovich et al. ..... 439/409
5,762,518 A * 6/1998 Tanigawa et al. ..... 439/409
5,785,548 A 7/1998 Capper et al. ..... 439/409
5,924,898 A 7/1999 Dutton et al. ..... 439/701
5,939,960 A 8/1999 Godel et al. ..... 335/126
5,947,761 A 9/1999 Pepe ..... 439/409
6,080,006 A 6/2000 Broder ..... 439/409
6,083,035 A 7/2000 Mackey et al. ..... 439/410
6,200,157 B1 3/2001 Ams et al. ..... 439/409
6,200,164 B1 3/2001 Martin et al. ..... 439/595
6,238,233 B1 * 5/2001 Drexler et al. ..... 439/409
6,437,678 B1 8/2002 Konz ..... 336/233
6,494,749 B1 12/2002 Chang ..... 439/701
6,592,381 B1 7/2003 Cohen et al. ..... 439/80

(Continued)

FOREIGN PATENT DOCUMENTS

DE 0 276 549 B1 8/1988

(Continued)

*Primary Examiner*—Javaid H. Nasri
(74) *Attorney, Agent, or Firm*—Hayes Soloway P.C.

(57) ABSTRACT

A plug connector consisting of a female plug and a male plug comprises a plurality of signal contacts that are combined into an assembly, and a plurality of power contacts that likewise are combined into an assembly. The power contact assembly has a housing provided with insulation piercing contacts, as well as a cable guide that includes a cable receiving opening and is pivotally provided on the housing, so that it can swivel between an open position in which a cable can be pushed into the cable receiving opening, and a closed position in which the cable is forced into the insulation piercing contact.

32 Claims, 8 Drawing Sheets

U.S. PATENT DOCUMENTS

2005/0032412 A1* 2/2005 Bolouri-Saransar et al. 439/409

FOREIGN PATENT DOCUMENTS

| | | |
|---|---|---|
| DE | 195 17 431 C 1 | 5/1995 |
| DE | 198 41 356 C 1 | 9/1998 |
| DE | 199 56 016 | 11/1999 |
| DE | 198 35 459 | 2/2000 |
| DE | 100 45 764 A 1 | 9/2000 |
| DE | 201 03 256 U 1 | 2/2001 |
| EP | 0310832 | 9/1988 |
| EP | 0735613 | 3/1996 |
| WO | WO 01/50548 | 7/2001 |

* cited by examiner 6
12
66
72
42
42
60
60
62
56
58
52
54
50
64

74
6
66
42
72
50
56

42
6
70
74
72
66
68
50

42
6
74
76
72
66
68
50

6
42
74
72
P
74
P
72
60
50

PLUG CONNECTOR

CROSS-REFERENCE TO RELATED APPLICATION

This application is a continuation of U.S. application Ser. No. 10/202,127, filed Jul. 24, 2002, now abandoned.

TECHNICAL FIELD

The invention relates to a plug connector consisting of a female plug and a male plug.

BACKGROUND OF THE INVENTION

Plug connectors are known in the most various designs. They may be used, for instance, for data transmission. A typical example are network plugs of the RJ45 type. Plug connectors can also be used for power transmission, i.e. for the energy supply of an electric device connected by means of the plug connector.

It is the object of the invention to provide a plug connector which is suitable both for signal transmission and power transmission, and in which the cables serving for power transmission can be connected with low expenditure.

BRIEF SUMMARY OF THE INVENTION

According to the invention, a plug connector consisting of a female plug and a male plug comprises a plurality of signal contacts that are combined into an assembly, and a plurality of power contacts that likewise are combined into an assembly. The power contact assembly has a housing provided with insulation piercing contacts, as well as a cable guide that includes a cable receiving opening and is pivotally provided on the housing, so that it can swivel between an open position in which a cable can be pushed into the cable receiving opening, and a closed position in which the cable is forced into the insulation piercing contact. Due to this design it is possible to connect the cables, to be connected, to the power contacts in the field without complicated tooling; precanned cables are not necessary. The two assemblies can be arranged so as to lie side by side in a plug housing of a plug, so that a particularly compact construction is obtained. For signal transmission, there may be provided in particular an RJ45 plug. For power transmission, there may be used contacts which engage into contact springs in the female plug and allow a transmission of currents up to 10 amps.

The cable guide is connected with the housing preferably by means of a film hinge. The latter can be formed in a simple manner during molding of the housing and the cable guide, which both are made of plastic; it is not required to use a conventional link consisting of a link pin and a link pin receptacle.

Further, it is preferably provided for that the power contact is provided with a protrusion which forms an abutment for a tool by means of which the cable guide can be brought into the closed position. With a tool abutting at the abutment, e.g. a screw-driver, it is possible to apply much higher forces onto the cable guide as would be possible if one presses on the cable guide by hand. This is particularly of advantage, because the cables used for power transmission have a comparably large cross-section and, therefore, can be forced into the insulation piercing contacts only with high effort.

For arresting the cable guide in the closed position, in which the cable is forced into the insulation piercing contact of the power contact, there may be employed, for instance, a protrusion on the cable guide that engages into an opening in the housing if the cable guide is in the closed position, or a latching tab on the housing which can engage the cable guide when it is in the closed position.

According to a preferred embodiment it is provided for that the signal contact assembly is provided with insulation piercing contacts and comprises a cable guiding member by means of which wires to be connected can be pressed into the insulation piercing contacts. It is in this way that the cables to be connected can be connected with the signal contacts in the field without complicated tooling; it is not required to employ precanned cables.

Advantageous designs of the invention will be apparent from the following detailed description.

BRIEF DESCRIPTION OF THE DRAWINGS

FIGS. 7*a* to 7*e* show the signal contact assembly in various stages during connecting a signal transmission cable;

DETAILED DESCRIPTION OF THE PREFERRED EMBODIMENTS

Figure 1:
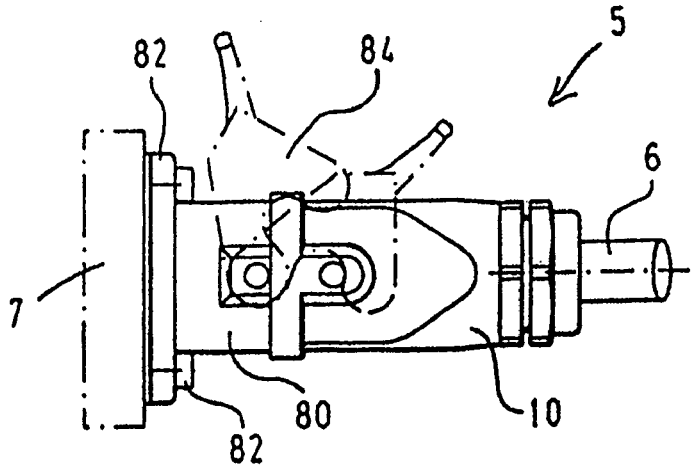
FIG. 1 shows in a side view a plug connector according to the invention.

FIG. 1 shows a plug connector 5 by means of which a cable 6 is connected with a device 7 to be connected. The plug connector 5 consists of a male plug 10 and a female plug 80. The female plug 80 is secured to the device 7 by means of screws 82 and has a locking lever 84 by means of which the male plug 10 can be locked on the female plug 80.

Figure 2:
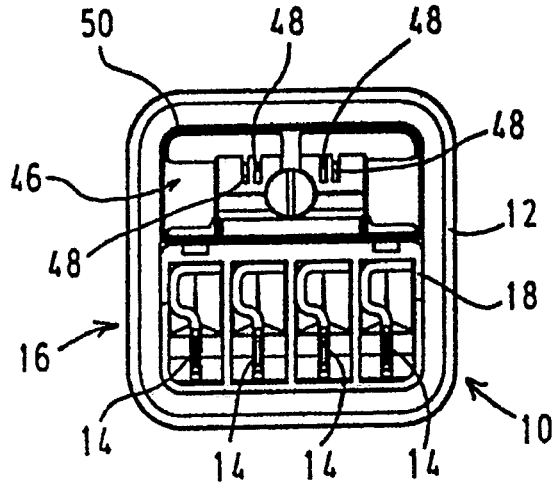
FIG. 2 shows a view of the insertion side of the male plug.

The male plug 10 has a plug housing 12 in which a plurality of power contacts 14 are arranged (see FIG. 2). The power contacts 14 are combined into a power contact assembly 16. To this end, the power contacts 14 are arranged in a power contact housing 18 which is shown in FIGS. 4 and 5.

The housing 18 has one contact chamber 20 for each of the power contacts, this chamber being open in longitudinal direction at both sides. On the housing 18, there is provided a plurality of cable guides 22 in such a manner that they each are associated with one contact chamber 20. Each of the cable guiding members 22 has a cable receiving opening 24 which terminates at a stop 26. A plurality of strain relief grooves 28 are configured in the cable receiving opening 24. There is further provided a recess 30 which extends transversely to the longitudinal direction of the cable receiving opening 24.

Figure 4A:
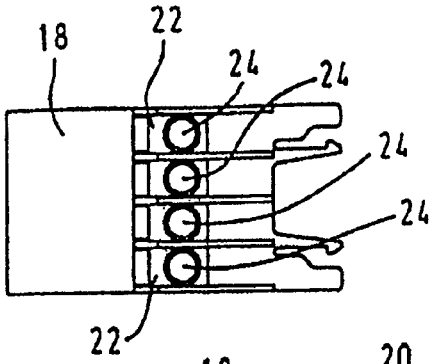
FIGS. 4*a* to 4*d* show the housing of the power contact assembly in a bottom view, a side view, a sectional view and a front view.
Figure 4B:
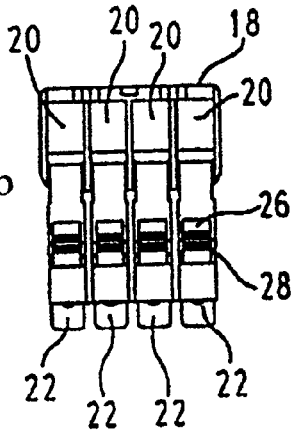
Figure 4C:
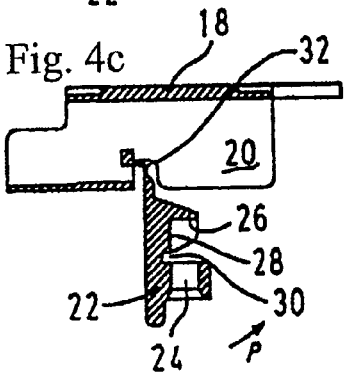
Figure 4D:
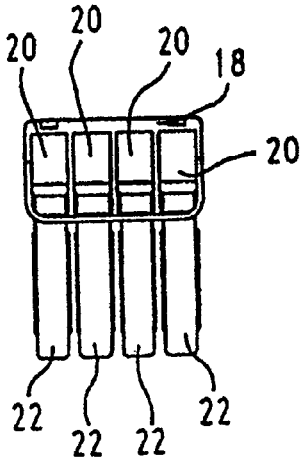
Figure 5A:
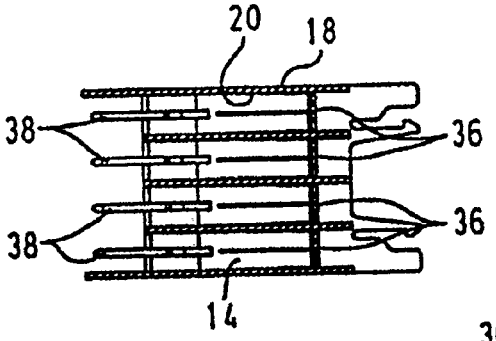
FIGS. 5*a* to 5*d* show the housing of FIG. 4 in a longitudinal section, a side view, a cross-section and a front view with the cable guide swung upwards, insulation piercing contacts being arranged in the housing.
Figure 5B:
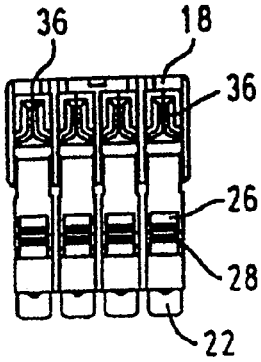
Figure 5C:
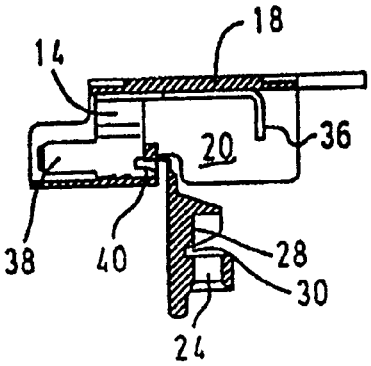
Figure 5D:
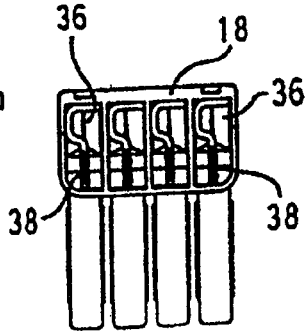
Figure 6:
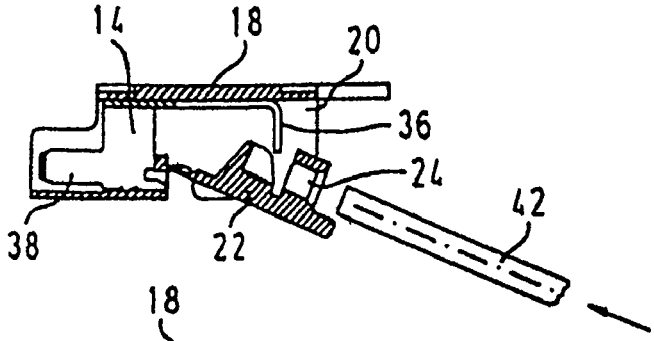
FIGS. 6*a* to 6*f* show the housing of FIG. 5 in various stages during connecting a cable to the insulation piercing contacts.
Figure 6:
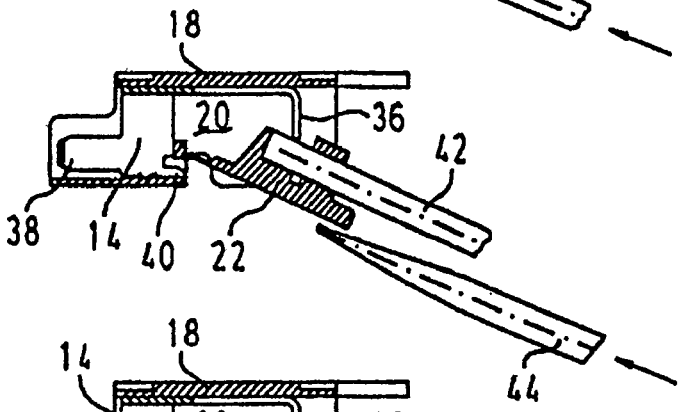
Figure 6:
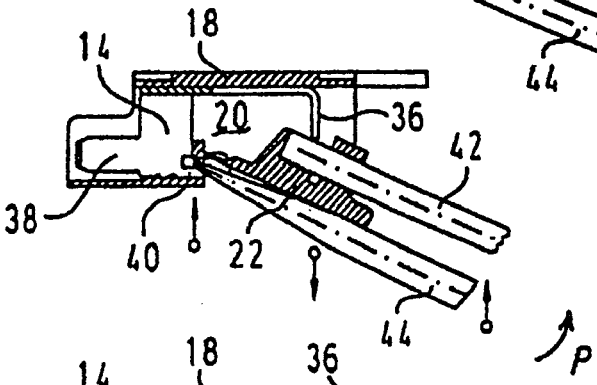
Figure 6:
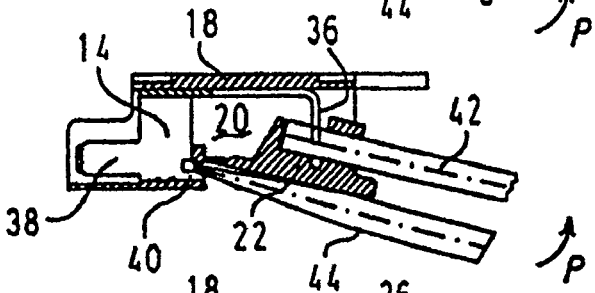
Figure 6:
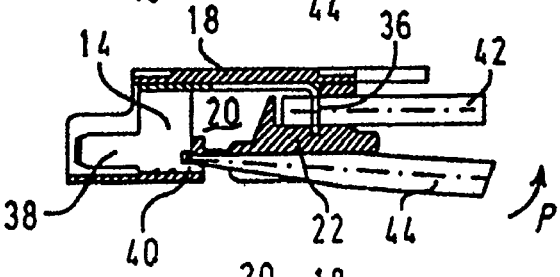
Figure 6:
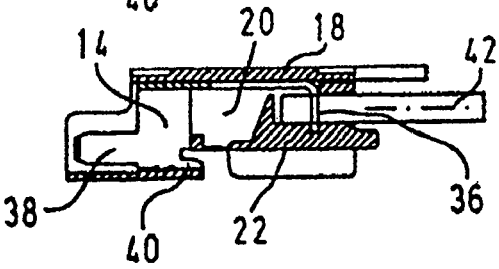

The cable guide 22 is connected with the housing 18 by means of a film hinge 32, i.e. by a thin, flexible web of material which is formed in one piece with the housing and the cable guide, so that the guide can be swung upwards from the position shown in FIG. 4 in the direction of arrow P of FIG. 4*c*.

In each of the contact chambers 20, there is arranged one of the power contacts 14 having an insulation piercing contact 36 and an insertion section 38. Finally, an abutment 40 is provided on the power contact 14, the function of which will be explained in the following by means of FIGS. 6*a* to 6*f*.

For connecting a power transmission wire 42, it will be inserted into the cable receiving opening 24 with the cable guide 22 being open (see FIG. 6*a*), until it rests at the stop 26. Next, a tool 44, this being a screw-driver in the example illustrated, is set in such a way that its tip rests at the abutment 40 of the power contact 14 (see FIG. 6*c*). By pivoting the tool 44 in the direction of arrow P of FIGS. 6*c* to 6*e*, the cable guide 22 is moved upwards about the pivot point defined by the film hinge 32, the wire 42 arranged in the cable receiving opening 24 being pressed into the insulation piercing contact 36. In so doing, the insulation piercing contacts 36 penetrates the recess 30 of the cable guide 22. As the cable guide 22 is able to rest at the tool 44 across a large surface area and the tool rests at the abutment 40, the cable guide is well guided during pivoting and the forces acting onto the film hinge 32 are comparably low.

FIG. 6*f* shows the cable guide 22 in its closed position swung upwards, in which the wire 42 is pressed into the insulation piercing contact 36, so that its insulation is cut through by the insulation piercing contact and electrical contact is made with the interior conductor. The strain relief grooves 28 in the cable guide 22 increase the resistance which counteracts a pulling-out of the wire 42 from the insulation piercing contact 36.

By using the insulation piercing contact 36 it is possible to connect the wires, that serve for power transmission, to the power contact assembly with minimum expenditure. The power contact assembly 16 is readily pre-assembled after insertion of the power contacts 14; the cable guide 22 is captively secured due to the film hinge 32. The wires 42 to be connected only have to be cut to their correct length. Stripping the insulation prior to connecting to the power contacts is not necessary. Moreover, no special tooling is needed for forcing the wires 42 into the insulation piercing contacts 36 by means of the cable guide 22. In case the wires 42 have a small cross-section, then the cable guide 22 can even be forced by hand from the open position into the closed position.

As can be seen in FIG. 2, a signal contact assembly 46 is also arranged in the plug housing 12 in addition to the power contact assembly 18, which in the embodiment illustrated has four signal contacts 48. The signal contacts 48 are received in a signal contact housing 50 which is shown in detail in FIG. 7*a*.

On its insertion side, the signal contact housing 50 is formed as a plug of the RJ45 type. On its rear side it has an enlarged receiving space 52, extending into which are insulation piercing contacts 54 of the signal contacts 48. A cable guiding member 56 can be pushed into the receiving space 52, which member is provided with a plurality of cable receiving openings 58. Each cable receiving opening is associated to one insulation piercing contact 54 and has on its rear side, from which a signal transmission wire 60 to be connected enters, first a straight section extending in axial direction, following thereto an obliquely extending section and finally again a straight section extending in axial direction. There is further provided a slot 62 which extends in axial direction and intersects with the cable guiding openings 58 in the region of their obliquely extending sections.

In order to connect the signal transmission wires 60, these are pushed—without a prior stripping of the insulation—into the cable guiding openings 58 of the cable guiding member. Then, the cable guiding member 56 is inserted in the receiving space 52, one insulation piercing contact 54 each penetrating a slot 62 in the cable guiding member 56. By tightening a fastening screw 64, the cable guiding member 56 is pulled into the receiving space 52 so far that the insulation piercing contacts 54 cut through the insulation of the wires 60 and make contact with the internal conductors. This state is shown in FIG. 7*b*.

Figures 7, 7A, 7B, 7C, 7D:
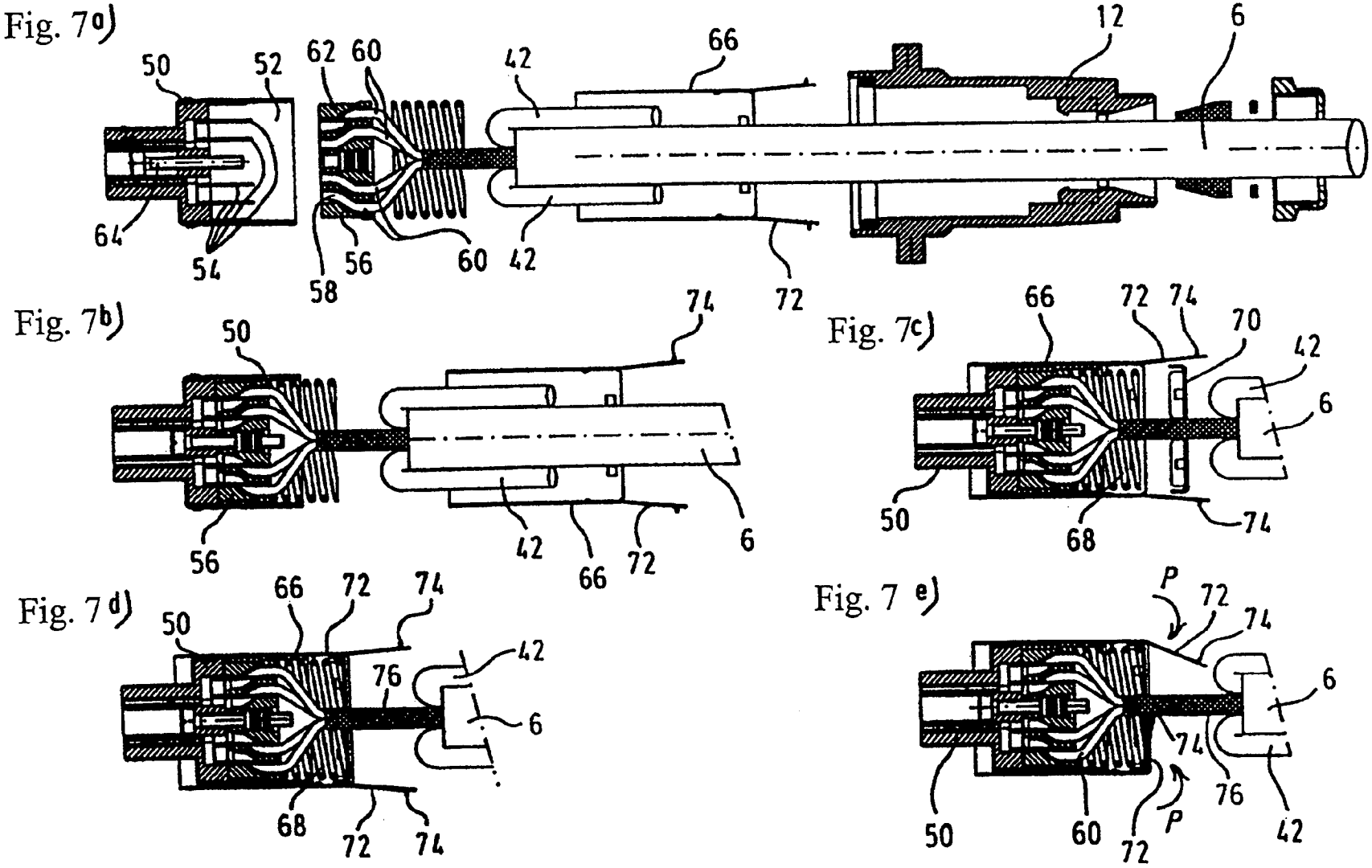

After contacting the wires 60, the housing 50 is pushed into a metallic shielding 66 in which it latches in place (see FIG. 7*c*). Next, a compression spring 68 resting at the cable guiding member 56 is inserted, which spring rests on its other end at a cover 70 (see FIGS. 7*c* and 7*d*). As a final step, two folding tabs 72 of the shielding 66 are folded down in the direction of the arrows P of FIG. 7*e*, so that they close the housing 50 on the cable entry side and latch the housing in a closed position. The folding tabs 72 are provided at their free end with a bent-off contact tab 74 which can engage a shielding braid 76 that surrounds the signal transmission wires 60. In this way there is obtained a full shielding of the signal contact assembly 46 with minimum expenditure.

Figure 8:
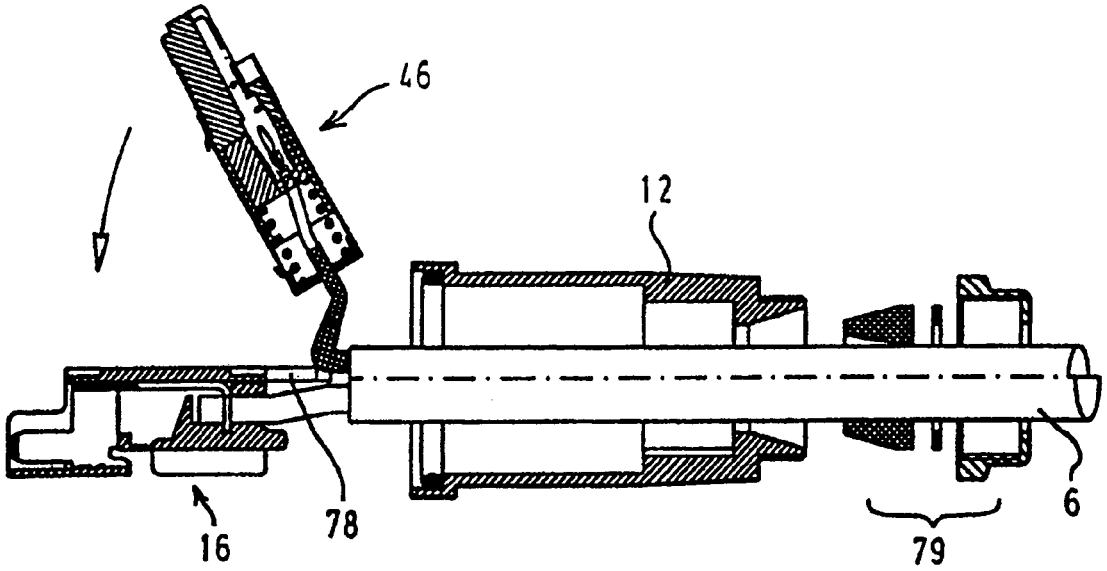
FIGS. 8*a* to 8*c* show a male plug part with a signal contact assembly and a power contact assembly in two stages during fitting.
Figure 8:
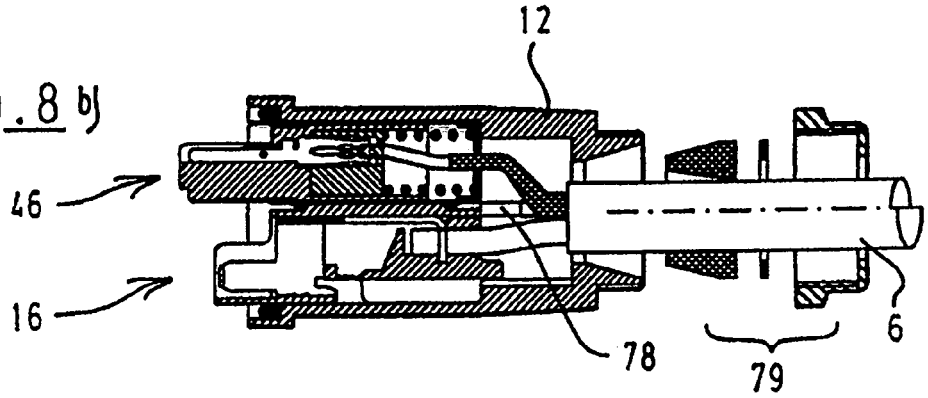
Figure 8:
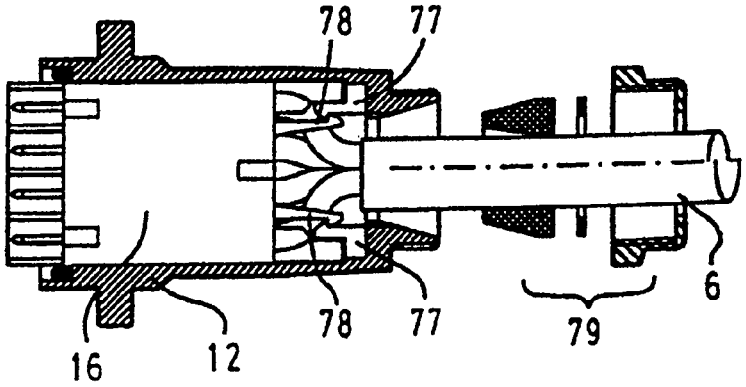

In FIGS. 8*a* to 8*c* there is shown how the power contact assembly 16 and the signal contact assembly 46 are arranged in the plug housing 12. The two assemblies are pushed into the plug housing 12 lying flat on top of each other, while holding tabs 77 on the plug housing 10 together with latching tabs 78 on the power contact assembly and/or on the signal contact assembly may be used to arrest these in the plug housing 12. On the rear side of the plug housing 12 there is applied a conventional cable fastener 79 which ensures the sealing and the strain-relief with respect to the cable 6.

Figure 3:
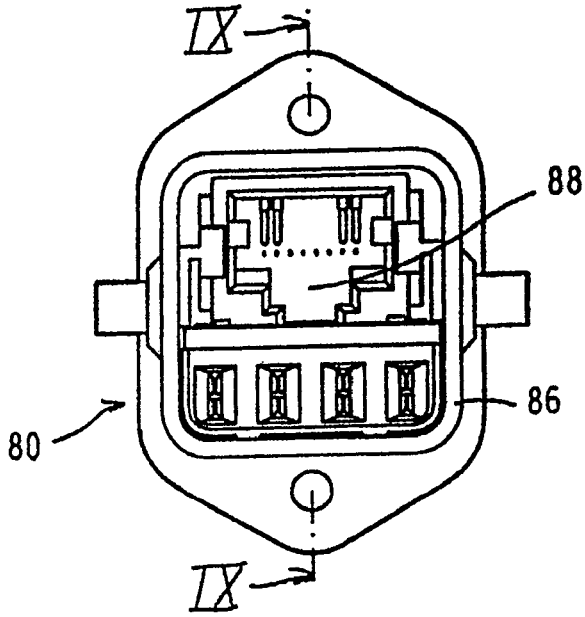
FIG. 3 shows a view of the insertion side of the female plug.
Figure 9:
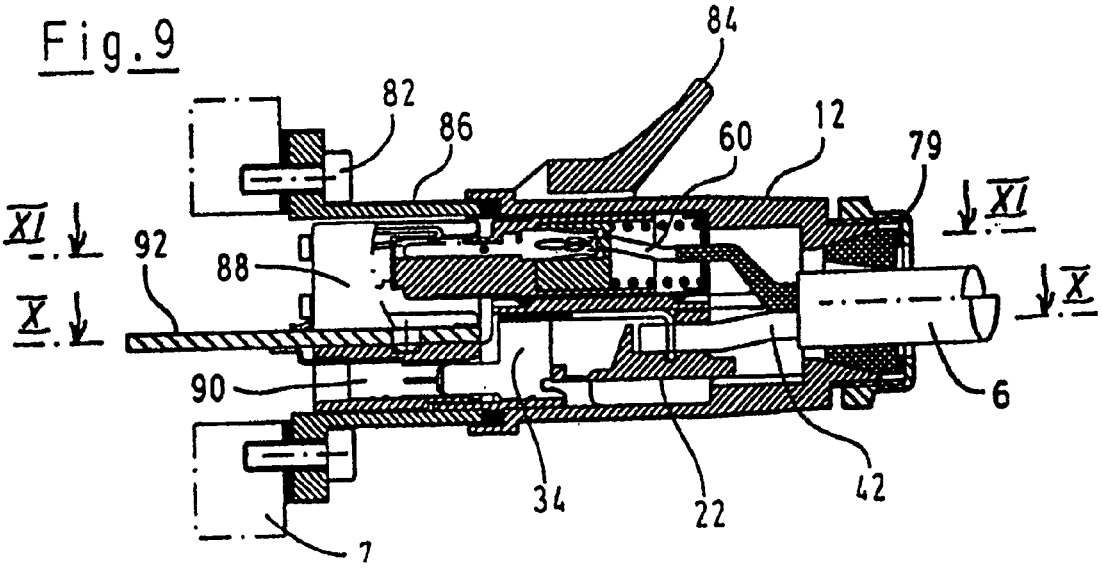
FIG. 9 shows a section through the plug connector along the plane IX—IX of FIG. 3.

As can be seen in FIG. 3, the female plug 80 is provided with a socket housing 86 in which are arranged a signal contact female plug 88 as well as a contact spring assembly 90 (FIG. 9). The signal contact female plug 88 is provided for receiving the insertion side of the signal contact assembly 46 (FIG. 8), and the contact spring assembly is provided for receiving the insertion sections 38 (FIG. 6) of the power contact assembly 16.

Figure 11:
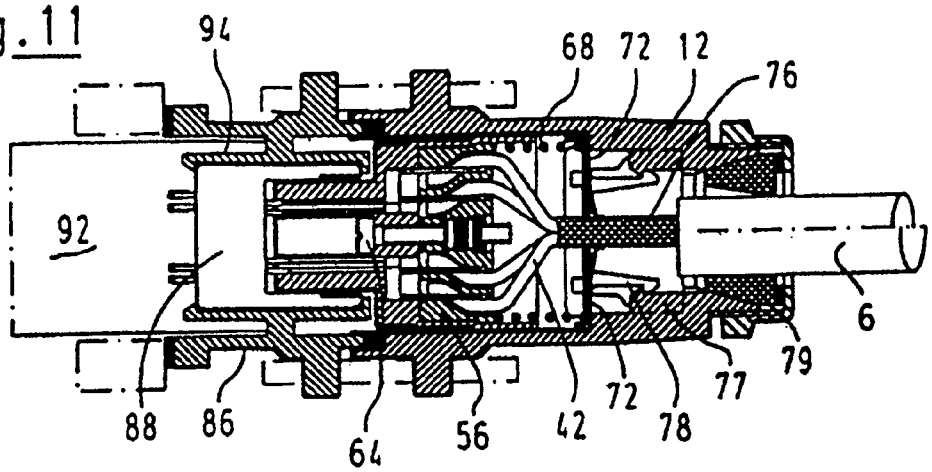
FIG. 11 shows a section along plane XI—XI of FIG. 9.
Figure 10:
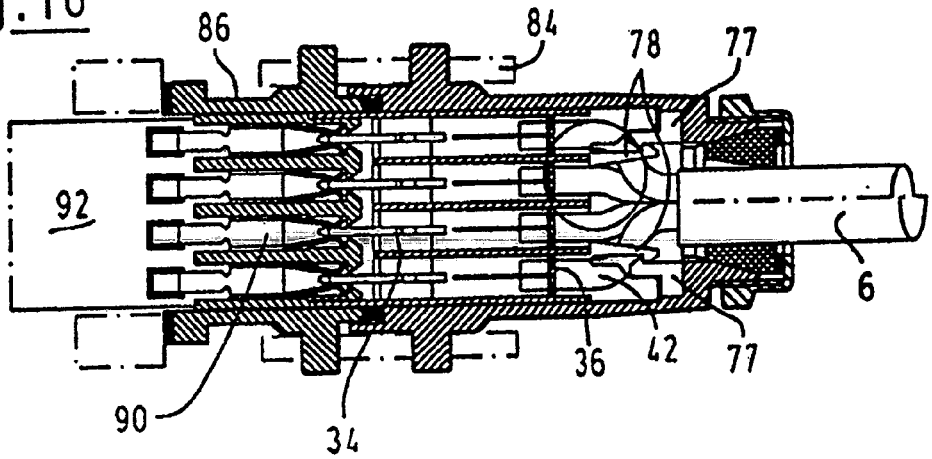
FIG. 10 shows a section along plane X—X of FIG. 9.

In FIGS. 9 to 11 there can be seen the interior of the plug connector 5, in the state when the male plug 10 is plugged into the female plug 80. As can be seen in FIG. 9, the signal contact female plug 88 and the contact spring assembly 90 are arranged on a printed circuit board 92 which serves for further transmission of the signals transmitted by the signal contacts, as well as of the current transmitted through the power contacts. As can be seen in FIG. 11, the signal contact female plug 88 is held in the socket housing 86 by means of locking tabs 94.

Figure 12:
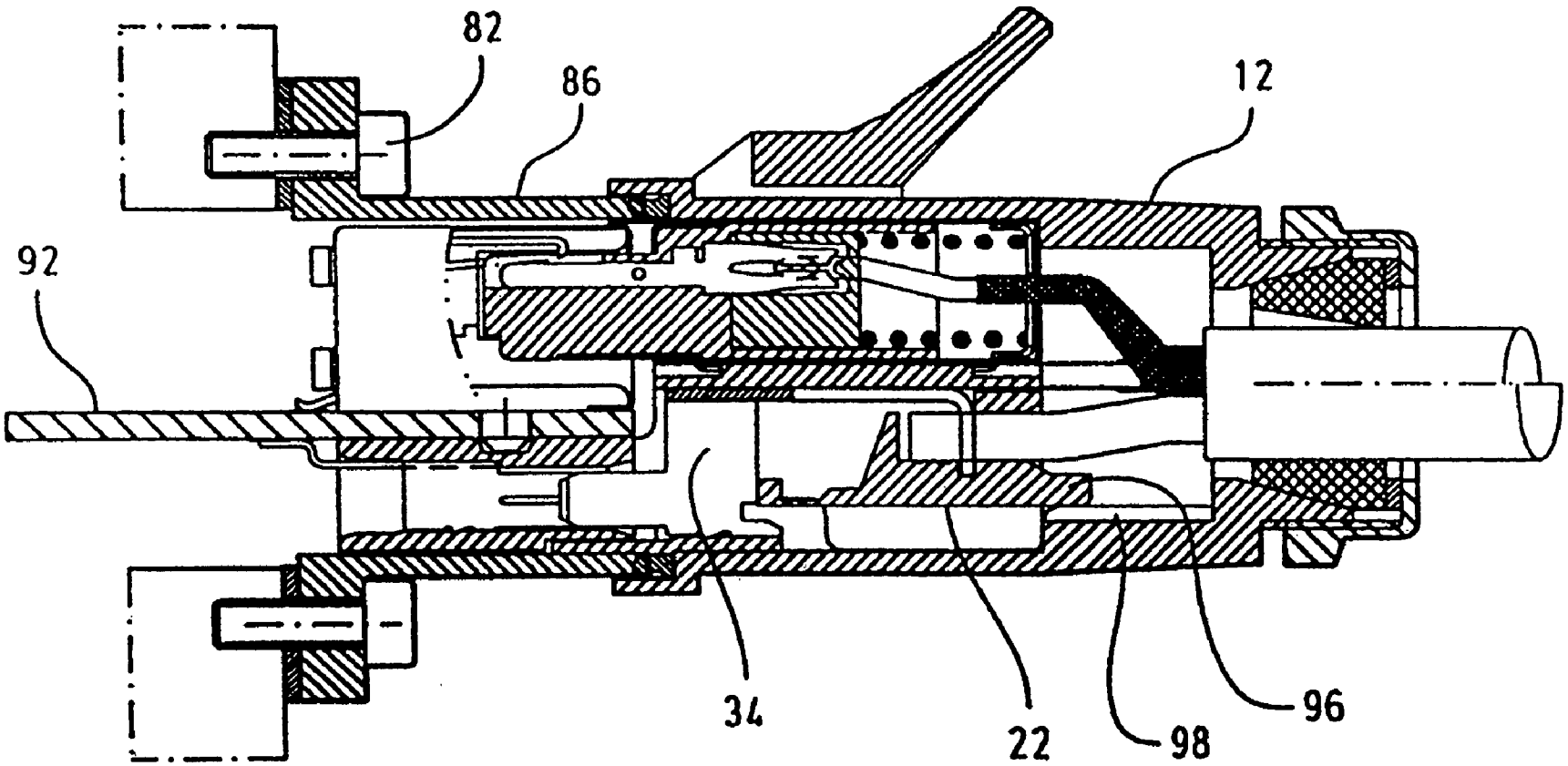
FIG. 12*a* and 12*b* show in views corresponding to that of FIG. 9 two variants of the plug connector according to the invention.
Figure 12:
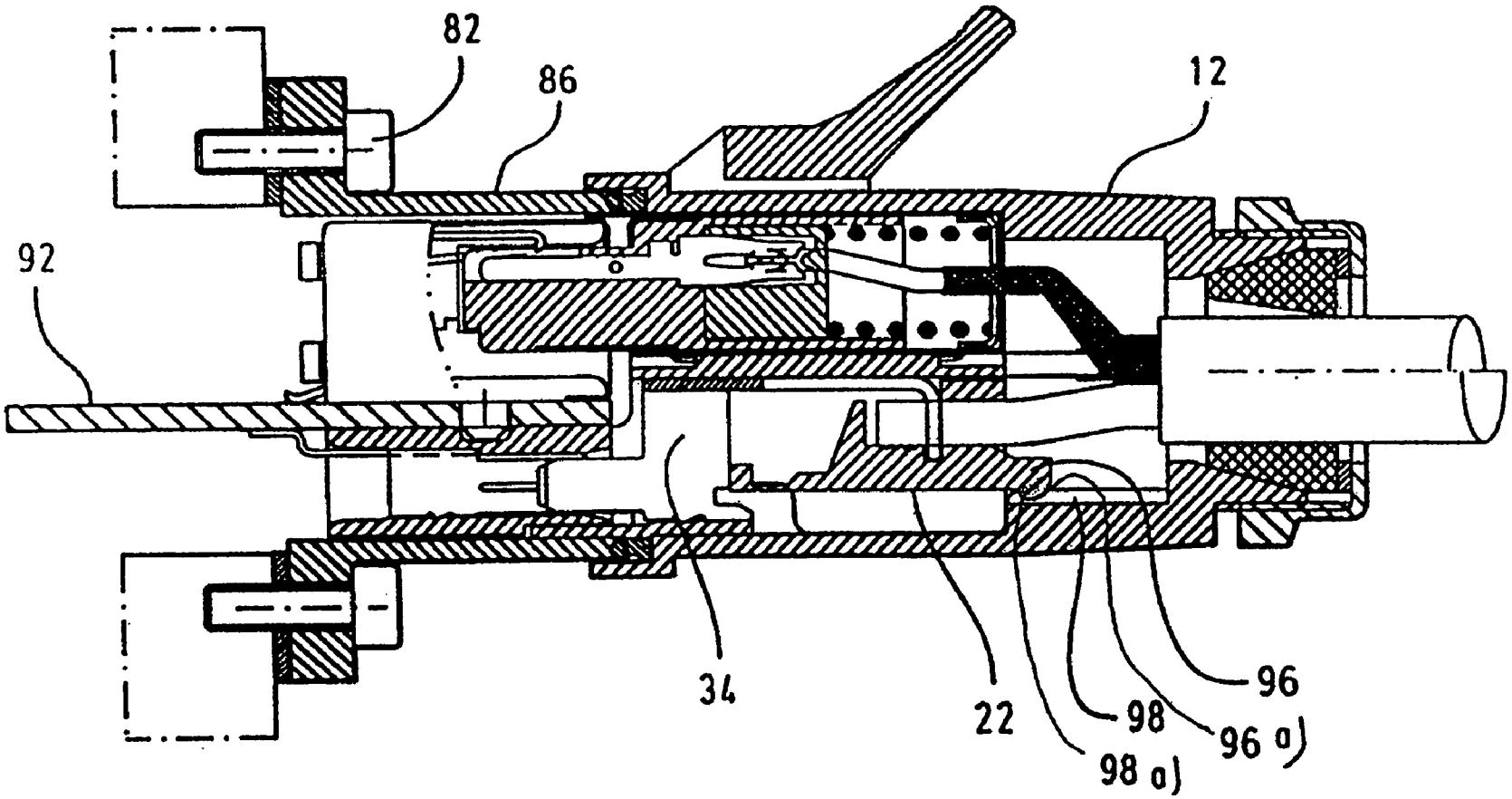

In FIGS. 12*a* and 12*b* there are shown two variants of the plug connector. These variants differ from the embodiment shown in FIGS. 1 to 11 in that the cable guide 22 is provided with a supporting nose 96 on its side facing away from the film hinge 32; this supporting nose rests at a supporting rib 98 in the plug housing 12 if the power contact assembly is mounted in the plug housing 12. It is in this way that the cable guide 22 is reliably held in its position, without the need of configuring a latching connection between the power contact housing and the cable guide. Also, as shown in FIG. 12*b*, a protrusion 96*a* may be formed adjacent the distal end of supporting nose 96 for engaging an opening 98*a* in the supporting rib 98.

The invention claimed is:

1. A plug connector having a female plug and a male plug, said plug connector comprising a plurality of signal contacts that are combined into an assembly, and a plurality of power contacts that likewise are combined into an assembly, said power contact assembly having a housing provided with insulation piercing contacts, as well as a cable guide that includes a cable receiving opening and is pivotally provided on said housing, so that it can swivel between an open position in which a cable can be pushed into said cable receiving opening, and a closed position in which said cable is forced into insulation piercing contact, wherein said power contacts are provided with protrusions which form abutments for a tool for urging said cable guide into said closed position.

2. The plug connector according to claim 1, wherein said cable guide is connected with said housing by a film hinge.

3. The plug connector according to claim 1, wherein one cable guide is provided for each of said insulation piercing contacts.

4. The plug connector according to claim 1, wherein one single cable guide is provided for all insulation piercing contacts.

5. The plug connector according to claim 1, wherein said protrusion can engage into an opening in said housing, so that said cable guide is latched in said closed position.

6. The plug connector according to claim 1, wherein provided on said housing is a latching tab for latching said housing in said closed position.

7. The plug connector according to claim 1, wherein said cable guide is provided with a supporting nose which rests at an associated supporting rib.

8. The plug connector according to claim 1, wherein said male plug comprises a plug housing, in which are accommodated said signal contact assembly and said power contact assembly.

9. A plug connector having a female plug and a male plug, said plug connector comprising a plurality of signal contacts that are combined into an assembly, and a plurality of power contacts that likewise are combined into an assembly, said power contact assembly having a housing provided with insulation piercing contacts, as well as a cable guide that includes a cable receiving opening and is pivotally provided on said housing, so that it can swivel between an open position in which a cable can be pushed into said cable receiving opening, and a closed position in which said cable is forced into insulation piercing contact, wherein said signal contact assembly is an RJ45 plug.

10. A plug connector having a female plug and a male plug, said plug connector comprising a plurality of signal contacts that are combined into an assembly, and a plurality of power contacts that likewise are combined into an assembly, said power contact assembly having a housing provided with insulation piercing contacts, as well as a cable guide that includes a cable receiving opening and is pivotally provided on said housing, so that it can swivel between an open position in which a cable can be pushed into said cable receiving opening, and a closed position in which said cable is forced into insulation piercing contact, wherein said signal contact assembly is provided with insulation piercing contacts and comprises a cable guiding member having a cable receiving opening for pressing wires to be connected into said insulation piercing contacts, and wherein a compression spring is provided which presses against said cable guiding member such that said insulation piercing contacts press into said wires.

11. The plug connector according to claim 10, wherein said cable guide is connected with said housing by a film hinge.

12. The plug connector according to claim 10, wherein one cable guide is provided for each of said insulation piercing contacts.

13. The plug connector according to claim 10, wherein one single cable guide is provided for all insulation piercing contacts.

14. The plug connector according to claim 10, further including a protrusion for engaging into an opening in said housing, so that said cable guide is latched in said closed position.

15. The plug connector according to claim 10, wherein provided on said housing is a latching tab for latching said housing in said closed position.

16. The plug connector according to claim 10, wherein said cable guide is provided with a supporting nose which rests at an associated supporting rib.

17. The plug connector according to claim 10, wherein said male plug comprises a plug housing, in which are accommodated said signal contact assembly and said power contact assembly.

18. A plug connector having a female plug and a male plug, said plug connector comprising a plurality of signal contacts that are combined into an assembly, and a plurality of power contacts that likewise are combined into an assembly, said power contact assembly having a housing provided with insulation piercing contacts, as well as a cable guide that includes a cable receiving opening and is pivotally provided on said housing, so that it can swivel between an open position in which a cable can be pushed into said cable receiving opening, and a closed position in which said cable is forced into insulation piercing contact, wherein a shielding is provided which surrounds said signal contact assembly.

19. The plug connector according to claim 18, wherein said shielding has a rear side where it is provided with at least one folding tab for engaging a shielding braid of a cable.

20. A plug connector having a female plug and a male plug, said plug connector comprising a plurality of signal contacts that are combined into an assembly, and a plurality of power contacts that likewise are combined into an assembly, said power contact assembly having a housing provided with insulation piercing contacts, as well as a cable guide that includes a cable receiving opening and is pivotally provided on said housing, so that it can swivel between an open position in which a cable can be pushed into said cable receiving opening, and a closed position in which said cable is forced into insulation piercing contact, wherein said plug housing is provided with at least one holding tab for latching at least one of said signal contact assembly and power contact assembly in said housing.

21. The plug connector according to claim 20, wherein said cable guide is connected with said housing by a film hinge.

22. The plug connector according to claim 20, wherein one cable guide is provided for each of said insulation piercing contacts.

23. The plug connector according to claim 20, wherein one single cable guide is provided for all insulation piercing contacts.

24. The plug connector according to claim 20, further including a protrusion for engaging into a cable receiving opening in said housing, so that said cable guide is latched in said closed position.

25. The plug connector according to claim 20, wherein said holding tab latches said housing in said closed position.

26. The plug connector according to claim 20, wherein said cable guide is provided with a supporting nose which rests at an associated supporting rib.

27. The plug connector according to claim 20, wherein said male plug comprises a plug housing, in which are accommodated said signal contact assembly and said power contact assembly.

28. The plug connector according to claim 20, wherein said power contact comprises a cable guiding member for pressing wires to be connected into said insulation piercing contacts.

29. The plug connector according to claim 28, wherein a compression spring is provided which presses said cable guiding member against said insulation piercing contacts.

30. The plug connector according to claim 29, further comprising a shielding having a rear side provided with at least one folding tab for engaging a shielding braid of a cable.

31. A plug connector having a female plug and a male plug, said plug connector comprising a plurality of signal contacts that are combined into an assembly, and a plurality of power contacts that likewise are combined into an assembly, said power contact assembly having a housing provided with insulation piercing contacts, as well as a cable guide that includes a cable receiving opening and is pivotally provided on said housing, so that it can swivel between an open position in which a cable can be pushed into said cable receiving opening, and a closed position in which said cable is forced into insulation piercing contact, wherein said female plug comprises a socket housing in which an RJ45 female plug is arranged, as well as contact springs which are associated to said power contacts.

32. The plug connector according to claim 31, wherein said contact springs are arranged in a shared housing, so that a contact spring assembly is formed.

* * * * *